US007754296B2

(12) United States Patent
Khoultchaev et al.

(10) Patent No.: US 7,754,296 B2
(45) Date of Patent: Jul. 13, 2010

(54) INK-JET MEDIA HAVING AN INK-VEHICLE PERMEABLE COATING AND A MICROPOROUS COATING

(75) Inventors: Khizyr K. Khoultchaev, Branford, CT (US); Cau T. Ho, East Haven, CT (US); Zhong Xu, Worcester, MA (US); Robert M. Conforti, Wakefield, RI (US)

(73) Assignee: Arkwright Advanced Coating, Inc., Chesapeake, VA (US)

( * ) Notice: Subject to any disclaimer, the term of this patent is extended or adjusted under 35 U.S.C. 154(b) by 403 days.

(21) Appl. No.: 11/237,358

(22) Filed: Sep. 27, 2005

(65) Prior Publication Data

US 2006/0068133 A1 Mar. 30, 2006

Related U.S. Application Data

(60) Provisional application No. 60/613,575, filed on Sep. 27, 2004.

(51) Int. Cl.
*B41M 5/40* (2006.01)

(52) U.S. Cl. ..... 428/32.18; 428/32.21; 428/32.22; 428/32.25; 428/32.31; 428/32.33; 428/32.34

(58) Field of Classification Search ..... 428/32.18, 428/32.21, 32.22, 32.25, 32.31, 32.33, 32.34
See application file for complete search history.

(56) References Cited

U.S. PATENT DOCUMENTS

| | | | | |
|---|---|---|---|---|
| 6,406,796 | B1 * | 6/2002 | Ohmura et al. | 428/511 |
| 6,610,388 | B2 * | 8/2003 | Xing et al. | 428/195.1 |
| 6,685,999 | B2 | 2/2004 | Ichinose et al. | 428/32.25 |
| 6,698,880 | B1 | 3/2004 | Campbell et al. | 347/105 |
| 6,855,382 | B2 | 2/2005 | Barcock et al. | 428/32.24 |
| 6,872,430 | B2 | 3/2005 | Burch et al. | 428/32.1 |
| 7,364,774 | B2 * | 4/2008 | Urscheler et al. | 427/420 |
| 2004/0048008 | A1 | 3/2004 | Yoshino et al. | 428/32.1 |
| 2004/0062880 | A1 | 4/2004 | Burch et al. | 428/32.1 |
| 2005/0008794 | A1 * | 1/2005 | Graczyk et al. | 428/32.24 |

FOREIGN PATENT DOCUMENTS

| | | | |
|---|---|---|---|
| EP | 0 887 199 | A2 | 12/1998 |
| EP | 1 403 091 | A2 | 3/2004 |
| JP | 2002103787 | * | 4/2004 |
| WO | WO 02/078967 | | 10/2002 |

* cited by examiner

*Primary Examiner*—Betelhem Shewareged
(74) *Attorney, Agent, or Firm*—Barlow, Josephs & Holmes, Ltd.

(57) ABSTRACT

An ink-jet media having an absorbent substrate with a front surface and a back surface. The front surface of the substrate is coated with an ink-vehicle permeable, preferably radiation-cured coating. A microporous ink-receptive coating is deposited on top of the ink-vehicle permeable coating. An optional protective layer may be deposited on top of the microporous ink-receptive layer. The back surface of the substrate may also be optionally coated with a polymer curl-controlling coating.

24 Claims, 6 Drawing Sheets

INK-JET MEDIA HAVING AN INK-VEHICLE PERMEABLE COATING AND A MICROPOROUS COATING

CROSS-REFERENCE TO RELATED APPLICATION

This application claims the benefit under 34 U.S.C. §119 (e) to U.S. Provisional Patent Application Ser. No. 60/613,575 filed Sep. 27, 2004, the contents of which are incorporated herein by reference.

BACKGROUND OF THE INVENTION

The present invention is directed to ink-jet printable media and more specifically to ink-jet printable media having an absorptive substrate, a ink-vehicle permeable coating, which may have been radiation cured, overlying the substrate and a microporous ink-receptive coating overlying the ink-vehicle permeable coating.

Ink-jet printing systems are highly effective for producing colored images on various substrates, such as papers, films, and other imaging media, that can be used in different applications. For example, ink-jet printed media have found many commercial uses for indoor and outdoor signage, posters, bulletins, advertising banners, and the like where vendors are looking to provide colorful graphic displays. Modern ink-jet printing systems employ various digital technologies, inks, and ink-jet printers to produce high-quality printed images on the imaging media.

In a typical ink-jet recording or printing system, ink droplets are ejected from a nozzle at high speed toward an imaging media to produce an image. The ink droplets generally comprise a recording agent, such as a dye or pigment, and a liquid vehicle. The vehicle can be made up of water, an organic material such as an alcohol and various other additives.

Inks used in ink-jet printers can be dye-based, pigment-based or a combination. In dye-based inks, the colorant (dye) is molecularly dispersed or solvated by a carrier medium. In pigment-based inks, the colorant exists as discrete particles. Some inks comprise both pigments and dyes.

The ink-jet imaging media generally comprises a substrate and an ink-receptive layer formed on an imaging surface of the substrate. The substrate can be selected from a wide variety of materials such as papers, films, non-woven webs, metal foils, and the like. This substrate is then coated with specially formulated ink-receptive compositions that are capable of receiving and holding the aqueous-based inks effectively so as to generate a quality printed image. Various surface finishes, such as matte, satin and gloss finishes can be achieved by proper selection of suitable substrate materials and coating compositions.

While the earliest forms of ink-jet media were a significant improvement over the use of plain paper, the ink-jet media industry has continuously strived to develop coated ink-jet media products capable of recording printed images having improved color brilliance, resolution, and density as well as other desirable properties. For example, one goal is to provide ink-jet media that resists fading of the ink under high ozone conditions. Ozone-fade resistance is a particularly desirable feature for ink-jet imaging media used in outdoor applications.

Generally speaking, all ink-jet imaging media should be capable of absorbing the ink quickly so that the printed image dries instantaneously or within a very short period of time but yet should have good water-resistance (i.e., the printed image should have good resistance to being smeared or rubbed off when the image is wetted.) Another common industry objective is to provide imaging media having at least a satin, and preferably, a glossy surface finish.

In recent years, the ink-jet industry has attempted to address the need for imaging media having improved print properties by developing ink-receptive coatings that commonly are referred to as "microporous" ink-receptive coatings. These microporous ink-receptive coatings contain particles and polymer binders. The particle and polymer binder materials, in combination, provide the ink-receptive coating with a microporous morphology that can better absorb aqueous inks.

Although ink-jet imaging media coated with microporous ink-receptive coatings have some advantageous properties and can effectively record high-quality images, in certain instances, some of these products can also have certain drawbacks.

Cracking of the microporous coating is one issue. For example, where a relatively high surface gloss, i.e. a gloss reading of 40 or more, is desired, it is often required to deposit a relatively thick layer of the microporous coating onto the underlying substrate (such as a paper substrate with a matte surface). The thick microporous coating will adequately receive the inks to form the printed image, but it is prone to developing small cracks during the manufacturing process. These coatings are typically applied to rolls of a substrate traveling in a continuous coating process. The substrate is coated and then passed through a drying tunnel to dry the coating before the next coating process. Thicker coatings require longer drying times, longer drying ovens and thus more manufacturing time and expense. Accelerating the drying process to reduce costs and manufacturing time tends to cause the coating to crack.

Thick coatings of the microporous material can also cause a change in color hue of the printed image. In some instances, composite colors contained in the printed image, which are produced by certain inks, do not appear as the intended color on the microporous coated layer. For instance, cyan (C), magenta (M), and yellow (Y) inks may be selected and applied to the medium in order to produce a composite black color, but the actual printed color may be a dark blue. It is believed that multiple scattering of the light within the microporous coating causes this color shift.

Finally, cost is another issue. The microporous coating materials are relatively expensive, and applying thick coats of the microporous material is expensive, driving up the price of these coated media.

It has been suggested that a radiation-cured polymer barrier coating, applied to the base substrate beneath the microporous coating, can lead to a glossy medium. See U.S. Pat. No. 6,610,388. However, because that radiation-cured coating forms a moisture barrier and thus is not permeable, the aqueous ink vehicle must be absorbed entirely within the microporous top coating. The microporous coating in that configuration does not need to be very thick to provide gloss, but it still needs to be thick enough to absorb all the aqueous ink vehicle. Accordingly, there is a trade-off between reducing the thickness of the microporous coating material enough to reduce its cost and cracking during manufacture, on the one hand, and increasing it to achieve good gloss and good drying characteristics, on the other.

There is thus a continuing need in the industry for improved ink-jet imaging media that has a relatively high gloss and superior printing characteristics, but yet does not require the application of a thick microporous ink-receptive layer.

SUMMARY OF THE INVENTION

The present invention provides ink-jet media having such improved print performance properties.

The present invention seeks to solve the drawbacks encountered with the use of microporous ink-receptive coatings by providing an ink-jet medium having an ink-vehicle permeable, preferably radiation-cured coating underlying the microporous coating. In particular, the ink-jet medium of the present invention comprises an absorbent substrate having a front surface and a back surface, an ink-vehicle permeable, preferably radiation-cured, coating overlying the front surface of the substrate, and a microporous ink-receptive coating overlying the ink-vehicle permeable, preferably radiation-cured, coating.

An optional outer protective coating may overlie the microporous coating. The back surface of the substrate may also include a polymer curl-controlling coating.

The absorbent substrate preferably comprises a paper substrate, such as a clay-coated paper. However, other absorbent substrates, such as synthetic fiber sheets, and porous polymer sheets also are contemplated, as well as composite substrate materials comprising a non-porous substrate with an absorptive layer coated on its surface.

A radiation-curable coating is preferably an ultraviolet (UV) curable oligomer or monomer, preferably acrylate-based, that is cured to afford a sufficiently ink-vehicle permeable coating to permit the ink vehicle to penetrate in a controlled manner through to the absorptive substrate. This permeability is a key feature of the invention. In contrast, prior art radiation-cured and other barrier coatings functioned as moisture barriers, preventing the absorption of the ink vehicle in the substrate. Further, coating layers that have had only a minor bulk effect on the permeation of vehicle from a microporous or other ink absorptive coating to an underlying absorptive substrate as defined herein, are not permeable in the meaning of this invention. As discussed later, the effect of the permeability can be determined by a Cobb test with the basic liquid constituent of the ink vehicle of the ink for which the medium is manufactured.

The microporous ink-receptive layer comprises a porous dispersion of particles and a polymer binder that quickly absorbs ink, but exhibits improved color brilliance, sharpness and fidelity.

The unique combination of the ink vehicle-permeable, preferably radiation-cured, substrate coating and the microporous ink-receptive layer cooperate to provide media with good gloss and ink drying characteristics with a thinner microporous layer than would be required in the absence of the permeable coating over an absorptive substrate. It may be improved further with an additional coating over the microporous layer.

Accordingly, among the objects of the present invention are: the provision of ink-jet media having superior print performance properties; the provision of ink-jet media having a glossy surface finish; the provision of ink-jet media that does not exhibit surface cracking; the provision of ink-jet media that includes a permeable, preferably radiation-cured, coating and a microporous coating that work in combination to provide the media with improved ink drying times with reduced microporous coating thickness with high gloss.

Other objects, features and advantages of the invention shall become apparent as the description thereof proceeds when considered in connection with the accompanying illustrative drawings.

DESCRIPTION OF THE DRAWINGS

In the drawings which illustrate the best modes presently contemplated for carrying out the present invention.

DESCRIPTION OF THE PREFERRED EMBODIMENT

Figure 1:
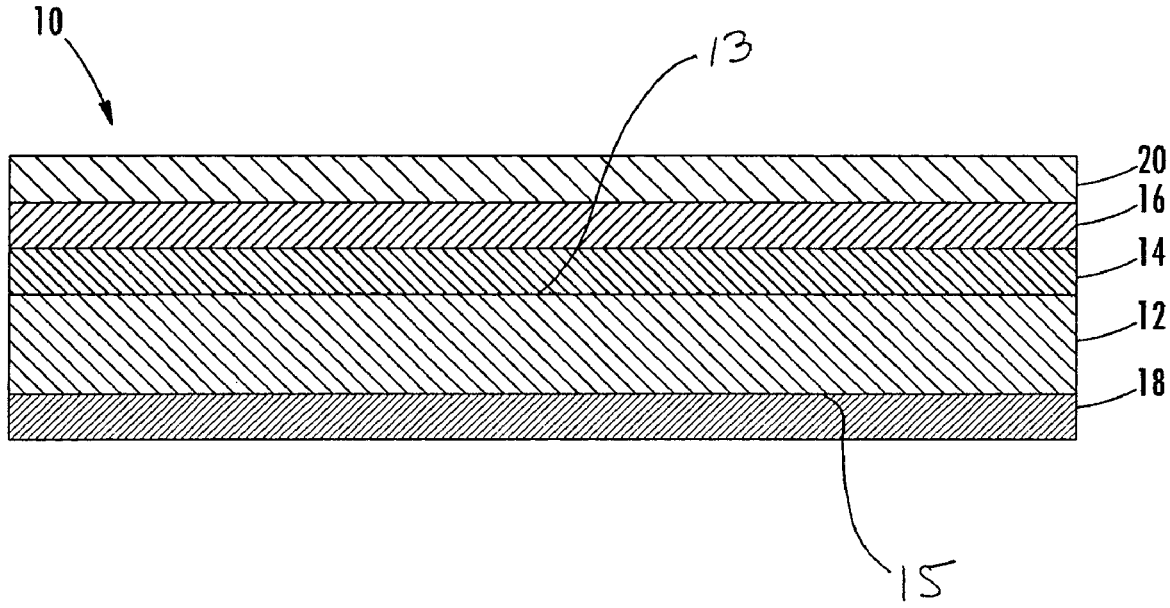
FIG. 1 is a schematic cross-sectional view of the preferred embodiment of the ink-jet media of the present invention.

Referring to FIG. 1, the ink-jet recording media of the present invention is shown generally at 10. As will be described in greater detail below, the ink jet recording media of the present invention 10 comprises an absorbent substrate 12, an ink-vehicle permeable, preferably radiation-cured coating 14 overlying a front or imaging surface 13 of the substrate, and a microporous ink-receptive coating 16 overlying the permeable coating 14.

An optional, curl-control coating 18 can be applied to the back surface 15 of the substrate 12 to help reduce curling and cockling of the media 10. Additionally, a protective layer 20 may be applied over the microporous ink-receptive coating 16 to help reduce ozone-fading problems. Optionally, coating 18 can be replaced with coating construction 14, 16 and 20 overlying surface 15 to produce a symmetrical medium that can be used without regard to "sidedness".

A. Substrate

Absorbent substrates 12 are well known in the printing industry, and can include a variety of different types of papers, boards and composite materials. In this regard, in the context of the present invention, the substrate 12 preferably comprises a paper substrate, and more preferably comprises a clay-coated paper. Plain papers, coated papers, treated papers, paperboard that is treated or untreated, synthetic fiber papers, and non-woven papers are also suitable for purposes of the present invention so long as they are absorbent alone or with an absorptive coating. Foam core board material is also a suitable substrate.

The substrate 12 may also be pre-treated with an adhesion promoter to enhance adhesion of the coating 14 to the substrate.

Substrate 12 with a range of glosses can be used in the context of the present invention, as the permeable coating 14 will provide the base on which a glossy surface can be achieved. Accordingly, less expensive matte and satin finish paper substrates can be used as a substrate for the media of the present invention.

Figure 2:
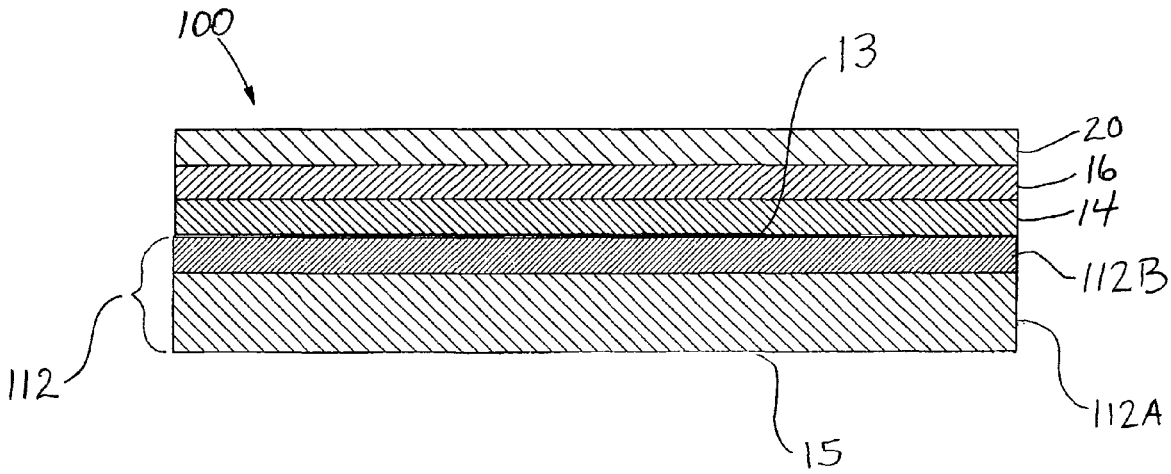
FIG. 2 is a schematic cross-sectional view of an alternative embodiment of the ink-jet media of the present invention.

Referring briefly to FIG. 2, an alternative embodiment of the invention is illustrated and generally indicated at 100. The alternative embodiment 100 includes an alternative composite substrate 112, which comprises a non-absorptive backing sheet 112A, and an absorptive layer 112B. The permeable, preferably radiation-cured, coating 14, and microporous top coating 16 are the same as their counterparts in FIG. 1, and have the same chemical compositions to be described hereinafter.

In this regard, the non-porous backing sheet 112A, preferably comprises a polymeric film such as, for example, polyethylene, polypropylene, polyester, naphthalate, polycarbonates, polysulfone, polyether sulfone, poly(arylene sulfone), cellulose triacetate, cellophane, polyvinyl chloride, polyvinyl fluoride, polyimides, polystyrene, polyacrylics, polyacetals, ionomers, and mixtures thereof. In other instances, a metal foil such as aluminum foil or a metal-coated material can be used as the backing sheet 112A.

To provide the substrate 112 with an absorbent surface, an absorbent layer 112B is applied to the non-absorptive backing sheet 112A. The coating 112B of this invention may be prepared from a coating formulation comprising one or a blend of ink-vehicle absorptive polymers, preferably from the group comprising an acrylic polymer, and acrylic copolymer, poly(vinyl pyrrolidone) (PVP), poly(2-ethyl-2-oxazoline) (PEOX), polyvinyl alcohol and carboxyalkyl cellulose and their variants in degree of substitution, hydrolysis, molecular weight and nature of the substituents. Here, alkyl means preferable methyl, ethyl and propyl, but is not limited to these and may be a combination, such as methyl, ethyl carboxycellulose. The acrylic copolymer, PVP, and PEOX are film-forming materials. The acrylic copolymer may be selected from such polymers as, for example, styrene acrylics (available under the tradenames of Joncryl 624 and Joncryl HPD-71 from Johnson Polymers). In one embodiment, a blend comprising an acrylic copolymer having a relatively low Tg and PVP is used. Particularly, a blend comprising an acrylic copolymer having a Tg of less than 25° C., and PVP can be used. For example, the acrylic copolymer, Joncryl 624 has a relatively low glass transition temperature (Tg) of about −30° C. The acrylic copolymer is typically present in the coating in an amount of about 60% to about 90%, and the PVP is present in an amount of about 10% to about 40% based on dry weight of the coating. It has been found that the combination of the Joncryl 624 material and the PVP provides a strong and durable substrate coating 112B which effectively supports the radiation-curable coating 14 and microporous top coat 16.

In another embodiment of the coating 112B, a blend comprising an acrylic copolymer having a relatively low Tg; an acrylic copolymer having a relatively high Tg; and PVP is used. For example, an acrylic copolymer having a Tg of less than 25° C. may be used in combination with an acrylic copolymer having a Tg of greater than 25° C. The acrylic copolymer having the relatively low Tg is typically present in the coating in an amount of about 20% to about 60%, the acrylic copolymer having the relatively high Tg is typically present in the coating in the amount of about 10% to about 40%, and the PVP is typically present in the coating in the amount of about 20% to about 40% based on dry weight of the coating. The acrylic copolymer, Joncryl HPD-71 has a Tg of about 128° C. It has been found that the combination of the Joncryl 624 and Joncryl HPD-71 materials and the PVP provides a coating having high mechanical strength at high drying temperatures.

In addition, it has been found that an acrylic copolymer or blend of acrylic copolymers having a relatively high acid functionality also provides the coating with beneficial properties. For example, it may be desirable to use an acrylic copolymer having an acid functionality of at least 25. Here, acid functionality and acid number are used interchangeably and have the conventional meaning that it is the number of milligrams of KOH required to reach equivalence (neutralize in the case of a strong acid) with one gram of the acid-containing material. The Joncryl 624 material has an acid number of 50, and the Joncryl HPD-71 material has an acid number of 214. It is believed that acrylic copolymers having a high acid functionality provide the coating with good absorptivity. The moisture sensitivity of the coating may be controlled and enhanced by using these high acid acrylic copolymers in combination with the PVP.

The coating 112B may also contain additives such as inhibitors, surfactants, waxes, plasticizers, cross-linking agents, dye fixatives, de-foaming agents, pigments, dispersing agents, optical brighteners, UV light stabilizers (blockers), UV absorbers, adhesion promoters, gel-promoters, such as sodium tetraborate-decahydrate, and the like.

B. Water Permeable, Radiation-Cured Coating

The ink-vehicle permeable, preferably radiation-cured, coating 14 of the present invention overlies the front surface 13 of the substrate 12 and enables the medium 10 to achieve a glossy surface finish without a very thick microporous layer. However, unlike the prior art barrier chemistries, which sealed the front surface of the substrate and prevented the ink vehicle (such as water) from penetrating into the substrate, the present vehicle permeable layer allows the ink vehicle to permeate through the coating 14 into the underlying absorbent substrate 12. As will be explained further hereinafter, the permeable nature of this internal coating 14 is a key feature of the invention both in the context of manufacturing and in the context of end use.

The permeable layer of this invention can work in combination with the microporous ink-receptive layer to provide an improved ink-jet media having a high gloss as well as significantly improved ink absorption and drying time. The microporous ink-receptive layer used to make the inkjet imaging media of this invention is described further below. Despite being somewhat permeable, the preferably radiation-cured layer of this invention makes it possible to achieve high surface gloss of the medium.

The coating 14 is identified as being permeable. One of its roles is to control the rate of permeation on the ink vehicle to the absorptive substrate. Another is to provide a base on which a relatively thin microporous layer can be applied to produce a medium with good drying and high gloss characteristics. A preferred way to produce this permeable coating layer is to apply a radiation curable coating, preferably acrylate-based, then radiation cure the radiation curable coating wholly or partially. The preferred form of radiation for this is ultra-violet (UV) light curing. However, other radiation curing technologies, such as x-ray or electron-beam curing, as well as other methods of forming permeable coatings with the appropriate permeability also can be used within the scope of the invention. During manufacture of the media, a radiation-curable composition is applied to the substrate and, thereafter, radiation from an electron beam, x-ray source or ultraviolet (UV) light source is used to cure this radiation-curable coating. In ultraviolet (UV) light radiation, photoinitiators (photosensitizers) typically are used to initiate the polymerization.

In the present invention, the radiation-cured coating 14 preferably is produced from a curable coating that comprises acrylate-based oligomers or monomers or a combination of them, and it can comprise urethane-modified acrylic monomers, or hydroxyl-terminated urethane oligomers, for example.

Preferably, in the present invention, UV light radiation is used to cure the coating, and in this regard the coating formulation preferably includes a photoinitiator. The coating may also contain additives such as inhibitors, surfactants, waxes, cure accelerators, defoaming agents, pigments, dispersing agents, optical brighteners, UV light stabilizers (blockers), UV absorbers, adhesion promoters, and the like.

In the manufacturing process, one or more UV-curable oligomers and or monomers are blended together with a photoinitiator and any additives. The mixture may be heated to reduce its viscosity. The coating formulation may be applied to the substrate 12 by any suitable method. Suitable methods for application of the monomers and/or oligomers (leading to coating 14) to the paper substrate 12 include, for example, Meyer-rod, roller, blade, wire bar, dip, solution extrusion, air-knife, curtain, slide, doctor-knife, and gravure methods. The vehicle-permeable radiation-cured coating 14 preferably has a coating weight between about 2 $g/m^2$ and about 10 $g/m^2$, and most preferably a coating weight of about 5 $g/m^2$.

Typically, the UV light has a wavelength in the range of about 150 nm to about 400 nm. Commercial UV light curing equipment may be used. Such equipment typically includes an UV light source (e.g., a tubular glass lamp), reflectors to focus or diffuse the UV light, and a cooling system to remove heat from the lamp area. After the curing steps, the UV-cured coating 14 may be treated with corona discharge to improve its adhesion to the microporous ink-receptive coating 16 to be applied over the coating 14.

C. Microporous Ink-Receptive Layer

The microporous ink-receptive coating 16 can be applied over the freshly irradiated ink-vehicle permeable coating 14. Generally, the microporous ink-receptive coating 16 comprises a dispersion of particles (pigment) and a polymer binder. The particle and polymer binder materials provide the ink-receptive layer with a porous morphology that enables the ink-receptive layer to better absorb the ink vehicle, such as water. The particles in the composition can form interstitial pores or voids in the ink-receptive coating 16 so that the coating 16 can absorb the ink by a wicking or capillary action. As ink is impinged onto the coating, it enters these interstitial voids and is absorbed. The dyes and/or pigments of the ink can be retained in the microporous layer. Some of the ink vehicle can pass through the permeable layer 14 into the absorptive substrate or absorptive layer on the substrate. This effectively increases the ink vehicle absorptivity of the microporous layer without increasing or requiring an increase in its thickness. The blend of particle and polymer binders in the ink-receptive layer significantly contributes to the relatively fast ink-drying times of the media.

The particles can comprise inorganic or organic particles. Suitable inorganic particles that can be used in the ink-receptive layer include, for example, those selected from the group consisting of kaolin, talc, clay, calcium sulfate, calcium carbonate, alumina, aluminum silicate, colloidal alumina, silica, colloidal silica, lithopone, zeolite, hydrated halloysite, magnesium hydroxide, magnesium carbonate, barium sulfate, titanium dioxide, zinc oxide, zinc sulfate, and zinc carbonate particles. These particles can be in the form of aerogels and/or xerogels as well as amorphous or crystalline materials. Suitable organic polymer particles include, for example, those selected from the group consisting of polyethylene, polypropylene, polyacrylate, polymethacrylate, polystyrene, polyamide, polyurethane, fluoropolymer, and polyester particles. The particles, themselves, can have a high surface area and porous structure. Such porous particles can absorb the aqueous ink vehicle themselves in addition to forming open voids in the ink-receptive layer.

In the present invention, the ink-receptive layer preferably is highly-loaded with particles. The porous ink-receptive layer typically includes about 70 to about 95 percent by weight and preferably 87 to 94 percent by weight of particles based on dry weight of the ink-receptive layer.

The binder resin used in the porous ink-receptive layer forms a film-like coating that anchors the particles in place, and provides cohesion and mechanical integrity to the porous ink-receptive layer. The binder material is generally water-soluble and includes, for example, materials selected from the group consisting of polyvinyl alcohols (PVAs); modified polyvinyl alcohols (e.g., carboxyl-modified PVA, silicone-modified PVA, maleic acid-modified PVA, and itaconic acid-modified PVA); poly(vinyl pyrrolidone); vinyl pyrrolidone copolymers; poly(2-ethyl-2-oxazoline); poly(ethylene oxide); poly(ethylene glycol); poly(acrylic acids); starch; modified starch (e.g., oxidized starch, cationic starch, hydroxypropyl starch, and hydroxyethyl starch), cellulosic polymers oxidized cellulose, cellulose ethers, cellulose esters, methyl cellulose, hydroxyethyl cellulose, carboxymethyl-cellulose, benzyl cellulose, phenyl cellulose, hydroxypropyl cellulose, ethyl hydroxyethyl cellulose, hydroxyethyl methyl cellulose, hydroxypropyl methyl cellulose, hydroxy butylmethyl cellulose, dihydroxypropyl cellulose, hydroxypropyl hydroxyethyl cellulose, chlorodeoxycellulose, aminodeoxycellulose, diethylammonium chloride hydroxyethyl cellulose, and hydroxypropyl trimethyl ammonium chloride hydroxyethyl cellulose); alginates and water-soluble gums; dextrans; carrageenan; xanthan; chitin; proteins; gelatins; agar; and mixtures thereof. In addition, the porous ink-receptive layer 16 may contain additives such as pigments, surface active agents that control the wetting or spreading action of the coating as it is applied to the substrate, anti-static agents, suspending agents, acidic compounds to control the pH of the coating, optical brighteners, defoamers, humectants, waxes, plasticizers, and the like.

The above-described coating techniques such as Meyer rod, roller, blade, wire bar, dip, die-extrusion, air knife, curtain, slide, doctor knife and gravure also can be used to apply the microporous ink-receptive coating 16 in accordance with this invention. In manufacture, the microporous ink-receptive coating is applied over the ink-vehicle permeable, preferably radiation-cured coating 14. The microporous coating 16 is preferably applied with a coating weight between about 8 $g/m^2$ and about 38 $g/m^2$, more preferably with a coating weight between about 18 $g/m^2$ and about 32 $g/m^2$, and most preferably with a coating weight of about 25 $g/m^2$.

The coated substrate is placed in an oven to dry the microporous ink-receptive coating. As discussed in the summary, because the microporous coating 16 is not thick, the coating 16 can be effectively dried in a short period of time, possibly at a higher temperature, with decreased attendant risk of cracking the coating during drying.

After the porous ink-receptive layer has been dried, a top protective layer may be applied over the porous ink-receptive layer as described further below.

D. Protective Layer

A relatively thin protective coating 20 may be applied over the microporous ink-receptive coating 16 in accordance with this invention. The protective coating 20 helps to protect the printed image from environmental conditions. For example, the protective coating may provide resistance to ozone fading of the printed image on the medium. With this protective coating, the ink-jet media may be capable of recording images that will resist fading due to ozone exposure. The ozone-protective coating may slow the photo-oxidation process, which is one of the primary causes for ozone-fading problems. The resins used in this protective coating must be capable of providing the final ink-jet media with good ozone fading resistance, but also must be capable of providing the media (in combination with the above-described radiation-cured and porous ink-receptive layers) with good water-resistance, a glossy surface finish, and very favorable ink dry time. Some resins are not suitable for use in the protective layer in accordance with the present invention. For instance, those resins that provide good ozone fading resistance but adversely affect image dry time or water resistance significantly would not be suitable. Preferably, the protective layer should help to reduce color hue shifts, which are associated with imaging some microporous layers, as mentioned above.

While a number of materials can provide such a protective coating, the preferred composition used to prepare the protective coating 20 in this invention is an aqueous solution comprising polyethylene oxide and a cellulosic polymer.

The polyethylene oxide used to prepare the protective layer is water-soluble. Suitable polyethylene oxide resins are commercially available such as PolyOx® from the Dow Chemical Company. The polyethylene oxide polymers should have a high molecular weight (at least 1000000 Daltons). Very tight molecular weight distribution is also preferred. A water-soluble derivative of methyl cellulose is used to prepare the ozone-protective layer in accordance with this invention. One example of a suitable derivative of methyl cellulose is hydroxy propyl methyl cellulose (Methocel®) available from the Dow Chemical Company. Higher molecular weight Methocel® products having tight molecular weight distributions are preferred for used in the protective coating. Silica and other inorganic or organic particles may be added to the formulation.

E. Coating of Back Surface of Substrate

In addition, the back surface 15 of the substrate 12 may be coated with a polymeric coating 18 that further helps prevent moisture from penetrating into the back surface 15 of the substrate 12. The polymeric coating 18 on the back surface of the substrate enhances the substrate's dimensional stability and helps minimize curling, cockling, and other defects. Applying the back coating 18 also provides a way to adjust the back surface-friction of the medium, which can be important in assisting the feeding of the imaging medium into the ink-jet printer, and typically also provides a way to control the anti-static properties to the ink-jet medium.

F. Advantageous Properties

The resulting ink-jet media 10 and 100 produced in accordance with this invention have many desirable properties and offer several improvements over conventional ink-jet media. Particularly, the permeable, preferably radiation-cured, coating 14 and microporous ink-receptive coating 16 cooperate to provide the media with a highly desirable glossy surface finish without the application of a thick microporous coating. The microporous coating and ink vehicle permeable coating also cooperate to provide improved ink drying times and good water-resistance after printing so that the printed image is less likely to smear or rub-off when the image is wetted. The thinner microporous coating also provides high quality prints having high color brilliance, sharpness, and fidelity. The thinner microporous coating is also effective for providing a medium that is substantially free of cracks.

G. In-Line Continuous Manufacturing Process

The present invention also encompasses a continuous, in-line process for making the ink-jet imaging medium. In general, the process comprises the steps of: a) applying the radiation-curable coating to the surface of the substrate; b) irradiating the radiation-curable coating so that the coating undergoes a curing process; and c) applying the porous ink-receptive coating over the freshly irradiated coating. As an option, the above-described protective coating can be applied over the microporous ink-receptive coating as another step in this in-line process.

H. Examples

Some examples of the ink-jet imaging media of this invention are illustrated below. These examples should not be construed as limiting the scope of the invention.

In the following examples, percentages are by weight based on the weight of the coating formulation, unless otherwise indicated.

Radiation-Cured Coatings

Example 1

| Trade Name | Supplier | Chemistry | % Weight |
|---|---|---|---|
| CD 9038 | Sartomer | Ethoxylated Bisphenol A Diacrylate | 66 |
| CN 2400 | Sartomer | Metallic acrylate | 25 |
| SR 706 | Sartomer | Modified Metallic acrylate | 2 |
| Darocur MBF | Ciba | Benzeneacetic acid, .alpha.-oxo-, methyl ester | 5 |
| BFD1149/ QFD1180 | Sun Chemicals | Organic pigment dye dispersion blend | 2 |

Example 2

| Trade Name | Supplier | Chemistry | % Weight |
|---|---|---|---|
| SR 399 | Sartomer | Dipentaerythritol Pentaacrylate | 37 |
| LR 8765 | BASF | Unsaturated Acrylic Resin | 30 |
| SR 610 | Sartomer | Polyethylene Glycol (600) Diacrylate | 30 |
| Darocur MBF | Ciba | Benzeneacetic acid, .alpha.-oxo-, methyl ester | 3 |

Example 3

| Trade Name | Supplier | Chemistry | % Weight |
|---|---|---|---|
| CN 2256 | Sartomer | Polyester Acrylate Oligomer | 10 |
| CN 132 | Sartomer | Aliphatic Diacrylate Oligomer | 53 |
| Darocur MBF | Ciba | Benzeneacetic acid, .alpha.-oxo-, methyl ester | 2 |
| Dispal 14N4-80 | — | Aluminum hydroxide dispersion | 25 |

-continued

| Trade Name | Supplier | Chemistry | % Weight |
|---|---|---|---|
| Water | — | H20 | 10 |

Example 4

| Trade Name | Supplier | Chemistry | % Weight |
|---|---|---|---|
| CN 2256 | Sartomer | Polyester Acrylate Oligomer | 33.5 |
| SR 9016 | Sartomer | Zinc Diacrylate | 25 |
| SR 9035 | Sartomer | Ethoxylated (15) Trimethylolpropane Triacrylate | 5 |
| Darocur MBF | Ciba | Benzeneacetic acid, .alpha.-oxo-, methyl ester | 3 |
| Water | — | H20 | 33.5 |

In each of the above Examples 1-4, the radiation-curable coatings were applied to the front surface 13 of a paper substrate (Glossy Cover Stock from Garda Cartiere or high sized, clay-coated base paper available from P.H. Glatfelter, Inc.). The coating was applied to the paper substrate using a "zero size" Meyer rod. Then, the coating was cured by a UV light source system.

Microporous Ink-Receptive Coatings

Example 5

| Trade Name | Supplier | Chemistry | % Weight |
|---|---|---|---|
| Poval 235 | Kuraray | Polyvinyl alcohol | 10.3 |
| Dispal 14N4-80 | Sasol | Aluminum hydroxide dispersion | 89 |
| BYK 380 | Byk-Chemie | Fluorinated acrylic | 0.1 |
| Glyoxal | Aldrich | Glyoxal | 0.5 |
| Chemcor 540C25 | Chemcor | PE emulsion | 0.1 |

The above-described ink-receptive coating in Example 5 was applied over each radiation-cured layer described in above Examples 1-4 using a Meyer #52 rod. The ink-receptive coating was dried in a convection oven for 3 minutes at 100 degrees C.

Example 6

| Trade Name | Supplier | Chemistry | % Weight |
|---|---|---|---|
| Poval 245 | Kuraray | Polyvinyl alcohol | 7.8 |
| Dispal 14N4-80 | Sasol | Aluminum hydroxide dispersion | 92 |
| BYK 380 | Byk-Chemie | Fluorinated acrylic | 0.1 |
| Chemcor 540C25 | Chemcor | PE emulsion | 0.1 |

The above-described ink-receptive coating in Example 6 was applied over each radiation-cured layer described in above Examples 1-4 using a Meyer #52 rod. The ink-receptive coating was dried in a convection oven for 3 minutes at 100 degrees C.

Comparative Example 1

In this comparative example, the following radiation-curable coating formulation was prepared.

| Chemical code | Supplier | Wt % | Chemistry |
|---|---|---|---|
| PUR 145 | Polymer Systems | 41 | Aliphatic polyester based urethane |
| SR 610 | Sartomer | 50 | Polyol Acrylate |
| Uvitex NFW LQ | Ciba | 5 | — |
| Darocur MBF | Ciba | 4 | Photoinitiator |

Comparative Example 2

In this comparative example, the following radiation-curable coating formulation was prepared.

| Chemical code | Supplier | Wt % | Chemistry |
|---|---|---|---|
| CN 991 | Sartomer | 55 | Aliphatic polyester based urethane |
| CN 2273 | Sartomer | 20 | Polyester Acrylate |
| CN 132 | Sartomer | 20 | Aliphatic diacrylate |
| KIP 100F | Sartomer | 5 | Photoinitiator |

The radiation-curable coatings, as described in the above comparative examples, were applied to a paper substrate in the manner as described in the above Examples 1-4.

Comparative Example 3

In this comparative example, the following swellable ink-receptive coating formulation was prepared.

| Ingredient | Parts | Chemistry | Supplier |
|---|---|---|---|
| Water | 66.5 | | |
| Methocel E-15 | 6 | Hydroxy Propyl Methyl Cellulose | Dow |
| Dispal 23N4-20 | 23 | Alumina Dispersion | Sasol |
| Witcobond 213 | 4.5 | Polyurethane emulsion | Crompton |
| Zirconyl Chloride | 0.5 | Zirconium Oxychloride | Aldrich |
| BYK 380 | 0.5 | Fluorine modified acrylic BYK | Chemie |

The above-described ink-receptive coating in Comparative Example 3 was applied over the permeable radiation-cured layer described in above Example 1 using a Meyer #16 rod. The ink-receptive coating was dried in a convection oven for 3 minutes at 100 degrees C.

TABLE 1

| Coating Combination | UV Cured Formulation | Microporous Formulation | Surface Gloss @ 60 degrees | Image Quality | Water Fastness | Image Dry Time | Comments |
|---|---|---|---|---|---|---|---|
| 1 | No coating | Example 5 | 18 | 4 | 5 | 4 | Low Gloss |
| 2 | Example 1 | Example 5 | 45 | 5 | 5 | 5 | |
| 3 | Comp. Exam. 2 | Example 5 | 42 | 2 | 3 | 2 | Intercolor Bleed |
| 4 | Comp. Exam. 1 | Example 5 | 37 | 3 | 4 | 5 | Coating Cracking |
| 5 | Example 1 | Comp. Exam. 3 | 80 | 4 | 1 | 2 | No Water Fastness |

Table 1 is a comparison of various properties of final ink-jet media products based on different coating combinations. A clay-coated paper was used as the base substrate in all coating combinations. Images were made using a Epson 820 Stylus Photo Printer.

Ratings: The printed media were evaluated on a relative scale of 0 to 5, where a rating of 5 means the printed medium has the best overall properties.

Properties of the printed media, which were prepared using different coating combinations are presented in the above Table 1.

Combination 1

Product represented as Combination 1 does not have a UV radiation-cured layer. The major disadvantage of this product is its low surface gloss. Printed images dry fairly quickly; however, image quality is not the highest because of the low reflection of the light from the surface.

Combination 2

Combination 2 is the best representative example of the invention. The printed product has the highest print quality attributes and surface gloss. Printed images dry immediately after being discharged from the printer. Combination 2 has very good water splash-resistance.

Combination 3

Combination 3 contains a UV radiation-cured layer that acts as a moisture barrier preventing penetration of water (ink vehicle) into the paper substrate. Therefore, the absorption power of the base paper is not being utilized to accommodate the ink volume. As the result, the printed image exhibits inter-color bleeding and takes a longer time to dry.

Combination 4

Combination 4 represents a different coating combination to Combination 3. The UV cured formulation of Combination 4 absorbs ink (water) too rapidly. This has an effect on the drying of the microporous coating layer and can lead to cracks in the microporous coating layer. Cracks reduce the surface gloss and cause printed image defects, particularly dyes migrate along the cracks creating "feather" like inter-color bleed patterns.

Combination 5

Combination 5 includes the ink-receptive coating of comparative example 3, which is not water-resistant. Printed images made on this sample can be easily smeared or completely destroyed if water is spilled onto the image.

TABLE 2

| Coating Combination | UV Cured Formulation | Microporous Formulation | Microporous Coat Weight | Surface Gloss @ 60 degrees | Crack Rating | Print Quality |
|---|---|---|---|---|---|---|
| 6 | Comp. Exam. 2 | Example 5 | 25 g/m$^2$ | 48 | 5 | Poor |
| 7 | Comp. Exam. 2 | Example 5 | 40 g/m$^2$ | 46 | 3 | Excellent |
| 8 | None | Example 5 | 25 g/m$^2$ | 17 | 4 | Marginal |
| 9 | None | Example 5 | 40 g/m$^2$ | 17 | 4 | Good |
| 10* | Example 1 | Example 5 | 25 g/m$^2$ | 48 | 5 | Excellent |
| 11 | Example 1 | Example 5 | 40 g/m$^2$ | 44 | 4 | Excellent |

Table 2 is a comparison of various print, cracking, and gloss properties of final ink-jet media products based on different coating combinations with an emphasis on showing differences in gloss and water absorption stemming from the use of ink-vehicle permeable, preferably radiation-cured coatings versus ink-vehicle barrier, preferably radiation cured coatings, and the coating thickness of the microporous layer. A clay-coated paper was used as the base substrate in all coating combinations. Images were made using a Epson 820 Stylus Photo Printer.

Gloss Ratings

Gloss of the coated products can be compared to the maximum achievable gloss for that particular microporous formulation. For the specific formulations disclosed in the criteria, gloss ratings can be classified as follows:

High Gloss—any reading above 80% of the maximum achievable gloss, i.e. above 40 @ 60 degrees angle if 50% reflection is taken as a maximum;

Moderate Gloss—readings between 50-80% of the maximum, i.e. readings between 25 to 40; and Low Gloss—any reading below 50% of the maximum, i.e. below 25.

(Micro-TRI-gloss meter marketed by BYK-Gardner used to evaluate surface gloss.)

Crack Rating:

Cracking manifests itself as gloss reduction of the final product. Also it causes image imperfections like inter-color ink bleeding know in the industry as "feathering", where the volume of ink of one color rapidly spreads out along the star shaped "channels" to the adjacent area of the other color causing a print defect. The criteria for the degree of cracking are based on visual inspection of the image surface of the coated substrates. For testing, a black square of 10 cm by 10 cm is printed on the final product and examined under an optical microscope at 5× magnification. The number of cracks in the printed area is counted and a rating assigned depending on the number of cracks detected. The rating system is as follows:

5—Crack Free—The coating is considered as crack free if no defects are found on the 100 $cm^2$ printed area;

4—Sample with 1-5 defects

3—Sample with 6-10 defects

2—Sample with 11-15 defects

1—Sample with 16 or more defects.

Combinations 6 and 7

Combinations 6 and 7 each include a ink-vehicle barrier UV-cured coating. Combination 6 has a thinner (25 $g/m^2$) coat weight while Combination 7 has a thicker (40 $g/m^2$) coat weight. The thinner microporous coating in Combination 6 provided a better crack rating (better drying), but exhibited poor print quality when combined with the UV-cured barrier coating (ink absorption stops at the barrier and is limited to the thinner microporous coating). The thicker microporous coating in Combination 7 exhibited better print quality, but a poor crack rating. Gloss was relatively equal because both include a UV-cured coating.

Combinations 8 and 9

Combinations 8 and 9 do not include any radiation-cured coating. Accordingly, both products had a lower gloss. The crack ratings were also similar, and both exhibited poor to marginal print quality.

Combinations 10 and 11 (Combination 10 is Most Representative of the Present Invention.)

Combinations 10 and 11 each included the ink-vehicle permeable, preferably UV-cured coating of the present invention. Combination 10 has the thinner microporous (25 $g/m^2$) coat weight while Combination 11 has the thicker microporous (40 $g/m^2$) coat weight. Both Combinations 10 and 11 had a relatively similar gloss. Combination 10 had a better crack rating than Combination 11. Again, the thinner microporous coating weight is more suitable to drying without cracking. Both Combinations 10 and 11 exhibited excellent print quality, emphasizing that the preferred embodiment of Combination 10 exhibits the same, if not superior, printing characteristics using a thinner microporous coating (⅓ thinner).

A comparison of Combinations 6 and 10 also illustrates the significant difference in print quality when using the ink-vehicle permeable, preferably UV-cured coating as opposed to the ink-vehicle barrier, preferably UV-cured coating. The print quality of Combination 6 is identified as poor while the print quality of Combination 10 is identified as excellent. The key difference is the ability of the media product in Combination 10 to more effectively absorb the ink by permeating through the permeable UV-cured coating.

Turning to FIGS. 3A-3D, the base paper (square—■), base paper plus permeable coating of Example 1 (star—*), along with coating combination 6 (triangle—▲), coating combination 9 (cross—x) and coating combination 10 (diamond—◆), were tested for water absorption using a standard TAPPI Cobb test (water absorption of sized paper and paperboard T-441).

A standard TAPPI Cobb test was performed on all samples in order to evaluate water absorption capacity of the substrates coated with radiation-cured and microporous coatings. The numbers reported in the Cobb tests are the weight of the absorbed water per square meter of the sample for a given time period. Series of tests with data points at various time increments were performed on each sample, and the amount of water absorbed was plotted against the test time.

Figure 3A:
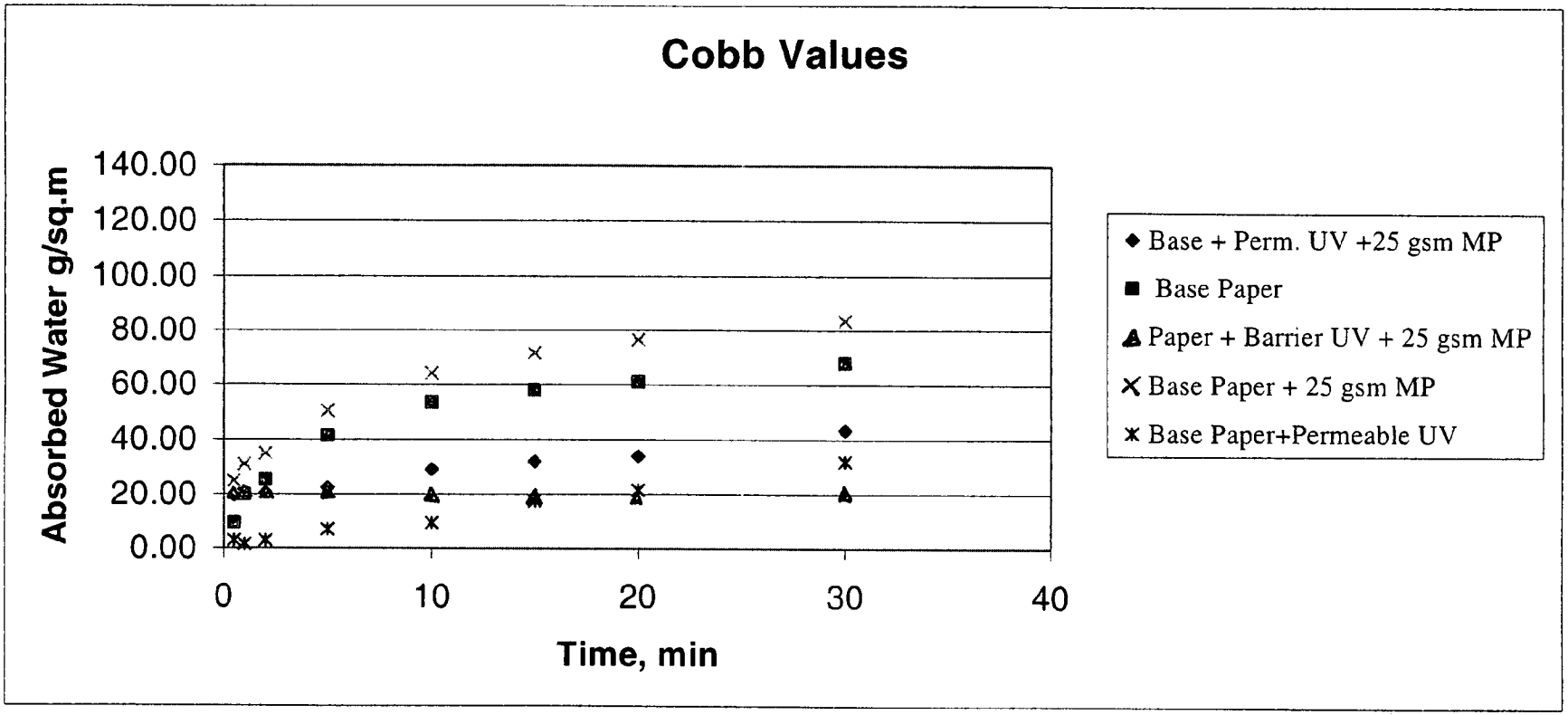
FIGS. 3A-3D are graphic depictions of Cobb test data comparing ink-vehicle barrier coated substrates with ink-vehicle permeable coated substrates.
Figure 3B:
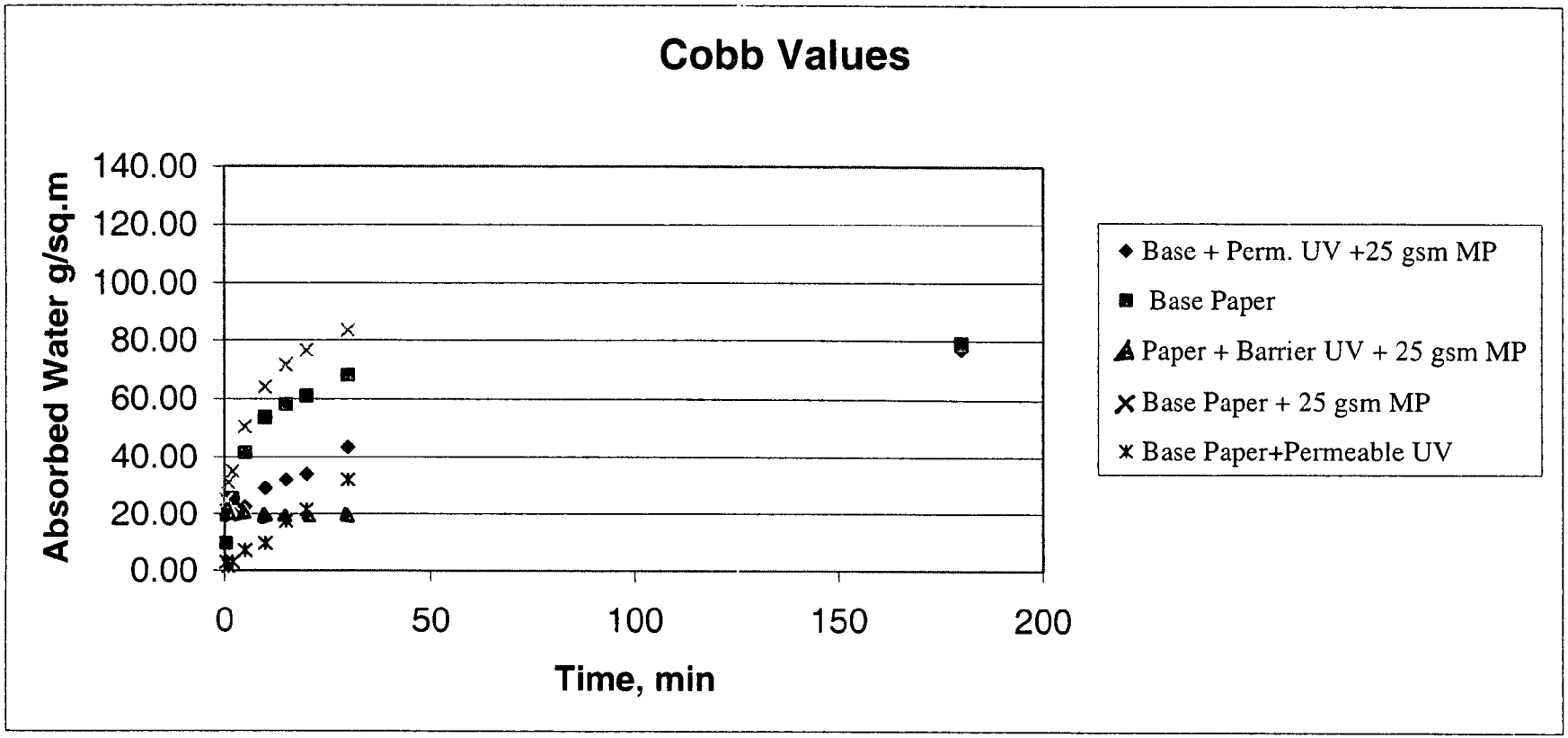
Figure 3C:
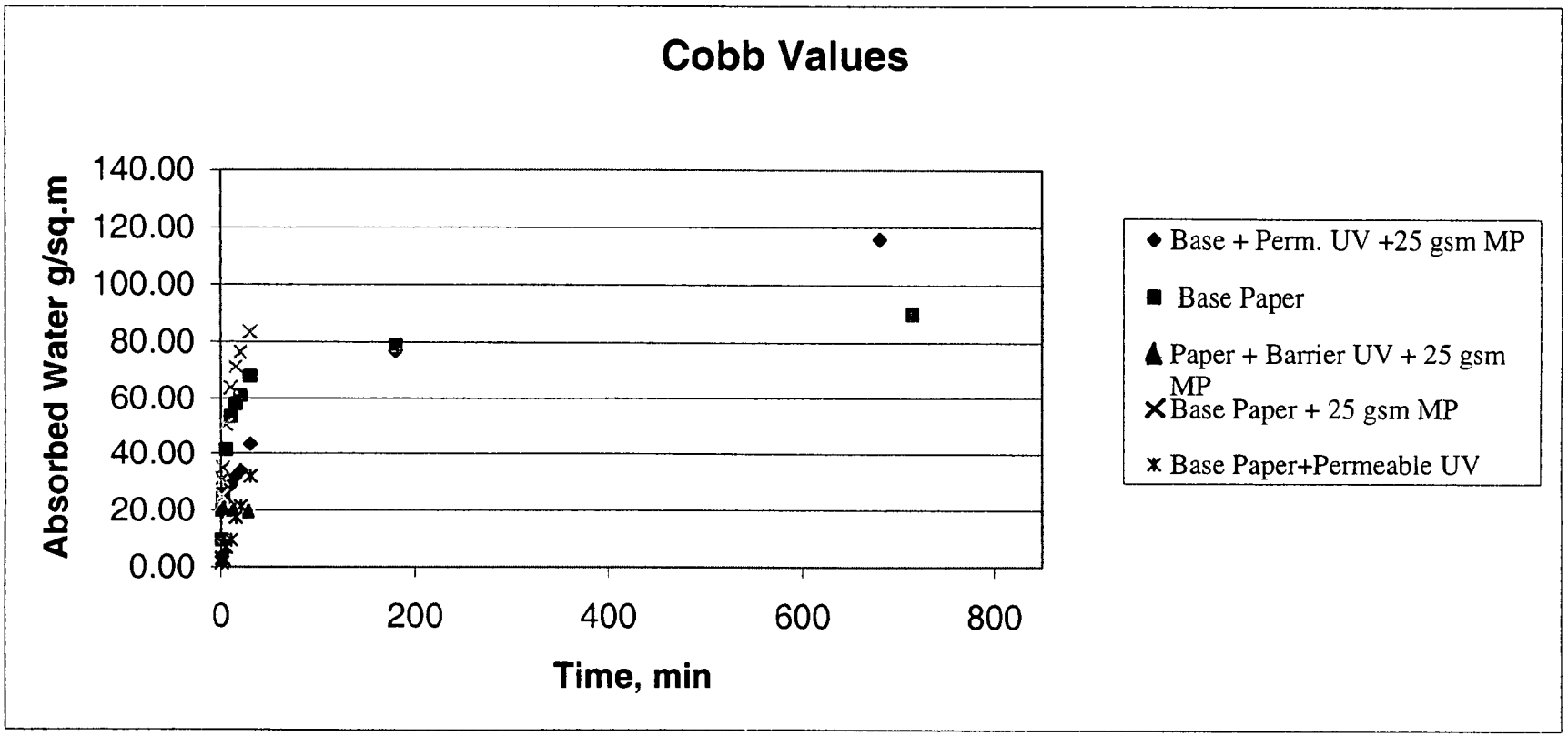
Figure 3D:
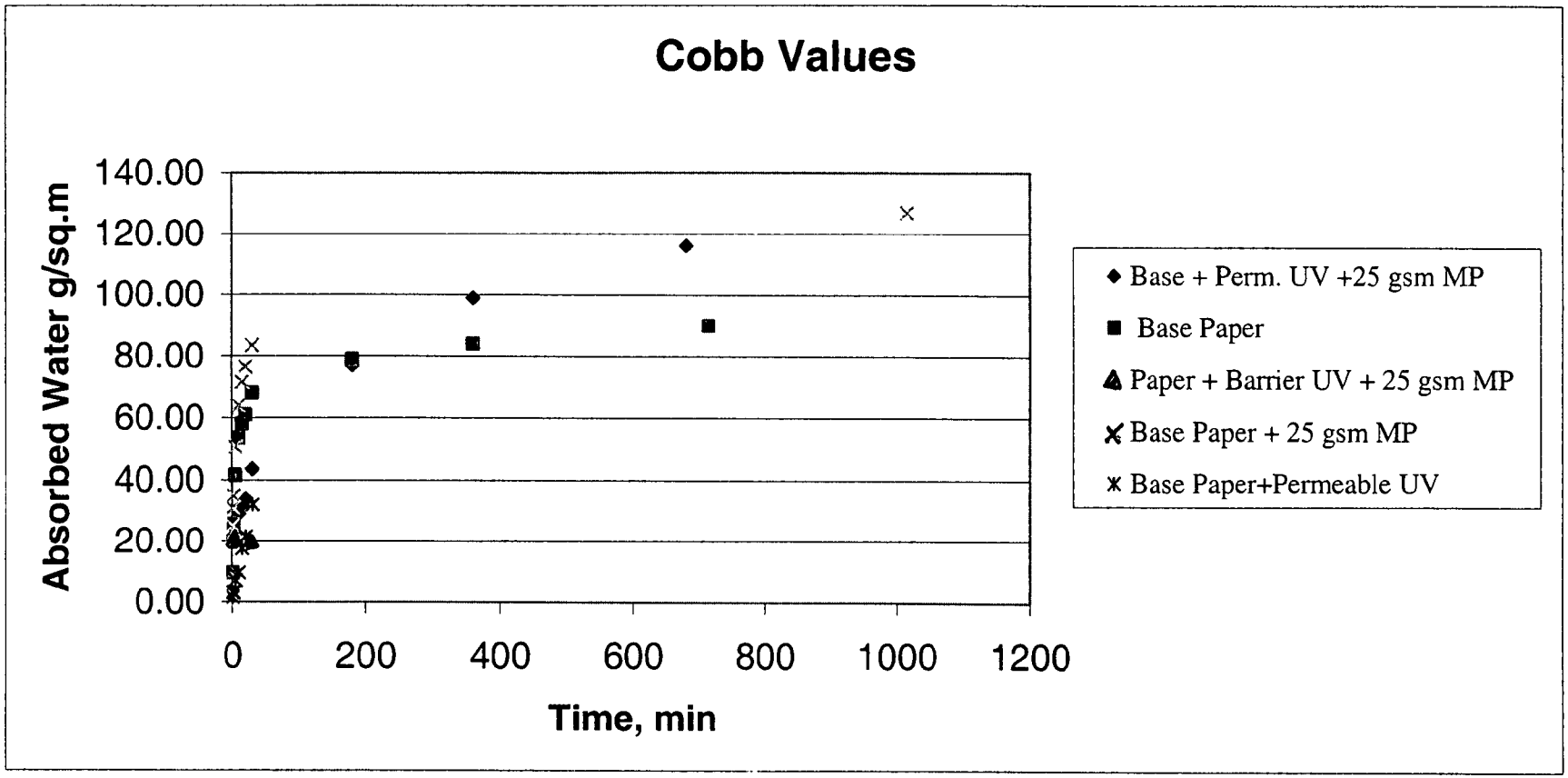

The purpose of the Cobb test is to provide a quantifiable difference in media products having a water-barrier coating as opposed to a water-permeable coating. FIG. 3A is a shorter 40 minute time frame, FIG. 3B is a longer 200 minute time frame, FIG. 3C is yet a longer 800 minute time frame, and FIG. 3D is an even longer 1200 minute time frame. All of the paper-based samples exhibit initial water absorption within the first few minutes, and then separate themselves based on differing absorption rates. The key comparison is between coating combinations 6 (triangle—▲) and 10 (diamond—◆), and is best seen in the shorter time period illustrated in FIG. 3A. Combination 6 (triangle —▲) UV-cured barrier plus microporous coating exhibits a flat or nearly zero (0) slope (no ongoing absorption) within the graph period after the initial uptake, identifying that water is not being absorbed into the base paper, whereas Combination 10 (diamond—◆) UV-cured permeable plus microrporous coating exhibits a positive slope (slow absorption) within the graph period after the initial uptake, identifying that water is slowly permeating through the permeable UV-cured coating. Looking at the sample data, it is apparent that all three samples including the 25 g/m microporous coating exhibit an initial water uptake of about 20 $g/m^2$ and confirms that the microporous coating itself is absorbing water. However, the UV-cured barrier coating in Combination 6 prevents any further water absorption into the base paper. In contrast, the permeable UV-cured coating permits a controlled absorption of water through the coating into the base paper substrate. Looking out further in time (FIG. 3B), the water absorption of the base paper (square—■) and Combination 10 (diamond—◆) eventually meet at about 180 minutes. Looking out in time even further (approximately 800 minutes), the water absorption of Combination 6 (diamond—◆) eventually exceeds that of the base paper alone by about 25 $g/m^2$. This leads us to the conclusion that the absorption of the base paper alone is about 80 $g/m^2$, and that about 20 $g/m^2$ of absorption is attributable to the microporous coating while an additional 5 $g/m^2$ of absorption is attributable to the permeable UV-cured coating.

The Cobb test slope is defined as the slope over a test range of 3 to 30 minutes of the best-fit straight line of the plot of the data of absorbed water ($g/m^2$) versus the time at which the Cobb measurements were made.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An ink-jet printable medium, comprising:

an absorbent substrate having a front surface and a back surface;

a radiation-cured, ink-vehicle permeable coating overlying the front surface of the substrate, said radiation-cured, ink-vehicle permeable coating allowing said ink-vehicle to permeate through said coating and into said underlying substrate;

said medium having a Cobb absorption slope of greater than 0.2 $g/m^2$/min within in a test range of about 3 minutes to about 30 minutes; and a microporous ink-receptive coating overlying the ink-vehicle permeable coating.

2. The medium of claim 1 further comprising a polymeric curl-controlling coating overlying the back surface of the substrate.

3. The medium of claim 1, further comprising a protective coating overlying the microporous ink-receptive coating.

4. The medium of claim 1, wherein the substrate is selected from the group consisting of paper substrates, polymer substrates, synthetic fiber substrates, and composite substrates having a backing sheet and an absorbent coating overlying the backing sheet.

5. The medium of claim 1 having a surface gloss of at least 35% measured at 60 degrees.

6. The medium of claim 1 wherein said radiation-cured, ink-vehicle permeable coating is applied with a coating weight between about 2 $g/m^2$ and about 10 $g/m^2$.

7. The medium of claim 6 wherein said radiation-cured, ink-vehicle permeable coating is applied with a coating weight of about 5 $g/m^2$.

8. The medium of claim 1 wherein said micro porous ink-receptive coating is applied with a coating weight between about 8 $g/m^2$ and about 38 $g/m^2$.

9. The medium of claim 8 wherein said micro porous ink-receptive coating is applied with a coating weight between about 18 $g/m^2$ and about 32 $g/m^2$.

10. The medium of claim 1 wherein said micro porous ink-receptive coating is applied with a coating weight of about 25 $g/m^2$.

11. The medium of claim 1 wherein an acrylate-based material is contained in said radiation-cured, ink-vehicle permeable coating.

12. The medium of claim 1 wherein said micro porous ink-receptive layer comprises a dispersion of particles and a polymer binder.

13. The medium of claim 1 having a Cobb absorption slope of greater than 0.5 $g/m^2/min$ within in a test range of about 3 minutes to about 30 minutes.

14. The medium of claim 1 having a Cobb absorption slope of about 0.8 $g/m^2/min$ within in a test range of about 3 minutes to about 30 minutes.

15. The medium of claim 4 having a Cobb absorption slope of greater than 0.5 $g/m^2/min$ within in a test range of about 3 minutes to about 30 minutes.

16. The medium of claim 4 having a Cobb absorption slope of about 0.8 $g/m^2/min$ within in a test range of about 3 minutes to about 30 minutes.

17. The medium of claim 5 having a Cobb absorption slope of greater than 0.5 $g/m^2/min$ within in a test range of about 3 minutes to about 30 minutes.

18. The medium of claim 5 having a Cobb absorption slope of about 0.8 $g/m^2/min$ within in a test range of about 3 minutes to about 30 minutes.

19. The medium of claim 11 having a Cobb absorption slope of greater than 0.5 $g/m^2/min$ within in a test range of about 3 minutes to about 30 minutes.

20. The medium of claim 11 having a Cobb absorption slope of about 0.8 $g/m^2/min$ within in a test range of about 3 minutes to about 30 minutes.

21. The medium of claim 5 wherein an acryl ate-based material is contained in said ink-vehicle permeable coating.

22. The medium of claim 21 having a Cobb absorption slope of greater than 0.5 $g/m^2/min$ within in a test range of about 3 minutes to about 30 minutes.

23. The medium of claim 21 having a Cobb absorption slope of about 0.8 $g/m^2/min$ within in a test range of about 3 minutes to about 30 minutes.

24. The medium of claim 1 wherein an acrylate-based material is contained in said radiation-cured, ink-vehicle permeable coating.

* * * * *